US005771432A

United States Patent [19]

Nakayama

[11] Patent Number: 5,771,432

[45] Date of Patent: Jun. 23, 1998

[54] IMAGE FORMATION SYSTEM WITH TONER SCATTERING PREVENTION

[75] Inventor: Nobuyuki Nakayama, Ashigarakami-gun, Japan

[73] Assignee: Fuji Xerox Co., Ltd., Tokyo, Japan

[21] Appl. No.: 726,854

[22] Filed: Oct. 4, 1996

[30] Foreign Application Priority Data

Dec. 19, 1995 [JP] Japan ..... 7-330528

[51] Int. Cl.[6] ..... G03G 15/16

[52] U.S. Cl. ..... 399/310; 399/302

[58] Field of Search ..... 399/121, 302, 399/311, 312, 310, 400

[56] References Cited

U.S. PATENT DOCUMENTS

| | | | |
|---|---|---|---|
| 3,966,199 | 6/1976 | Silverberg | 271/275 |
| 4,862,215 | 8/1989 | Nomura et al. | 399/400 |
| 5,040,028 | 8/1991 | Kamimura et al. | 399/302 |
| 5,140,376 | 8/1992 | Gotoda et al. | 399/311 |
| 5,223,903 | 6/1993 | Russel et al. | 399/400 |
| 5,303,018 | 4/1994 | Terada et al. | 399/299 |
| 5,408,302 | 4/1995 | Manzer et al. | 399/306 |

FOREIGN PATENT DOCUMENTS

| | | |
|---|---|---|
| U-1-57768 | 4/1989 | Japan . |
| A-2-163779 | 6/1990 | Japan . |
| A-3-267971 | 11/1991 | Japan . |
| A-4-186387 | 7/1992 | Japan . |
| 4-345185 | 12/1992 | Japan . |
| 7-110629 | 4/1995 | Japan . |

*Primary Examiner*—Arthur T. Grimley
*Assistant Examiner*—Quana Grainger
*Attorney, Agent, or Firm*—Oliff & Berridge, PLC

[57] ABSTRACT

An image formation system which includes a latent image support drum 11 on which a latent image is formed, an image formation unit 30 for forming a latent image on the latent image support drum 11, a developing device 14 for developing the latent image formed on the latent image support drum 11, an intermediate transfer medium belt 16 for receiving transfer of the toner image formed on the latent image support drum 11, a transfer charger 15 for transferring the toner image formed on the latent image support drum 11 onto the intermediate transfer medium belt 16, electric field giving means 25 for causing a force in an attraction direction toward the intermediate transfer medium belt 16 to act on the toner image transferred onto the intermediate transfer medium belt 16, a secondary transfer roll 24 for transferring the toner image transferred onto the intermediate transfer medium belt 16 onto a recording medium 23, and a fuser for fixing the toner image transferred onto the recording medium 23.

22 Claims, 15 Drawing Sheets

IMAGE FORMATION SYSTEM WITH TONER SCATTERING PREVENTION

BACKGROUND OF THE INVENTION

1. Field of the Invention

This invention relates to an image formation system adopting a so-called electrophotographic system for forming a latent image on a latent image support and developing the latent image with toner, thereby forming a visible image.

2. Description of the Related Art

An image formation system adopting an electrophotographic system, particularly a color image formation system uses a transfer drum system or a transfer belt system for electrostatically or mechanically holding a recording medium on a recording medium transport member and transporting it on the transport member or an intermediate transfer system for once transferring multiple colors onto an intermediate transfer medium before transferring to a recording medium in batch from the necessity for stably transporting recording media such as transfer paper or the necessity for repeating transfer more than once.

The transfer systems mainly adopt an electrostatic transfer method to transfer an image onto a transfer medium such as an intermediate transfer medium or a recording medium, thus charges the media. However, if excessive charge is stored on the transfer medium, it may cause toner transferred onto the transfer medium to scatter, resulting in various faults.

For example, to electrostatically hold a recording medium on a recording medium transport member such as a drum or a belt, the transfer drum system or transfer belt system often uses a dielectric substance, etc., as the recording medium transport member. Thus, charge supplied at a transfer position is held on the rear face of the recording medium transport member for a long time and is gradually stored, interfering with image formation as described above. Then, electricity removal means of a corona discharge system, etc., needs to be installed to remove excessive charge on the recording medium transport member. However, it is feared that installation of such electricity removal means will lead to a complicated configuration of the image formation system and an increase in costs. Also, such electricity removal means is easily affected by change of environmental conditions, etc.

The intermediate transfer system can use an intermediate transfer medium with a semiconductive material so that excessive charge is not stored, whereby supplied charge diminishes in a short time and disappears soon. Thus, the problem as with the transfer drum system of transfer belt system described above does not occur. However, the intermediate transfer system involves another problem as described below:

FIG. 12 is a graph to show a diminishing state of charge supplied to a semiconductive intermediate transfer medium.

The horizontal axis of FIG. 12 represents distances indicated by minus values toward the downstream side of an intermediate transfer medium with the transfer position just below a latent image support as zero, and the vertical axis represents charge densities. The intermediate transfer medium has volume resistance $10^{10}\Omega$cm, relative permititive 10, process speed 160 mm/sec, and transfer current value 20 $\mu$A.

As seen in FIG. 12, the charge starts to diminish rapidly at the zero position (transfer position), and almost disappears when arriving at the position of −10 mm. Thus, the semiconductive intermediate transfer medium does not require any special means for removing charge.

However, a study of the inventor et al. shows that if a semiconductive material is used for the intermediate transfer medium, the following problem occurs: After a toner layer having a predetermined charge is transferred electrostatically onto the intermediate transfer medium, charge supplied from a transfer charger, etc., to the intermediate transfer medium for use as a motive force of transfer diminishes gradually, thus repellant of charges of toner causes the toner to scatter, resulting in remarkable image degradation.

The toner behavior before and after transfer will be discussed with reference to FIGS. 13 to 15.

FIG. 13 is a schematic diagram of an image formation system adopting the intermediate transfer system according to prior art.

As shown here, a toner image T is formed on a latent image support drum 11 by a charger, an image exposure device, a developing device, etc., (not shown) disposed on the periphery of the latent image support drum 11 formed on the surface with a photosensitive substance. In this case, the toner image T has negative charge. An intermediate transfer medium belt 16 being placed on a drive roll 71 and a tension roll 17 rotating in the arrow C direction for turning in the arrow B direction is disposed approaching the latent image support drum 11. The toner image T formed on the latent image support drum 11 is transferred onto the intermediate transfer medium belt 16.

A transfer charger 15 is provided on the rear side of transfer position P of the intermediate transfer medium belt 16 opposed to the latent image support drum 11 for supplying positive charge of polarity opposite to the toner image T to the intermediate transfer medium belt 16. The toner image T on the latent image support drum 11 is transferred onto the intermediate transfer medium belt 16 by the charge.

FIGS. 14A and 14B are diagrammatic illustrations showing change of a potential distribution and an electric field distribution associated with change of a gap between the latent image support drum and the intermediate transfer medium belt.

FIGS. 14A and 14B diagrammatically show the latent image support drum in the upper part toward the paper face and the intermediate transfer medium belt in the lower part and a gap and a toner layer transferred onto the intermediate transfer medium belt between the latent image support drum and the intermediate transfer medium belt. The potential distribution is represented as contour lines and the electric field distribution is represented by arrow directions. The arrows representing the electric field distribution are indicated only for both left and right ends and the center of the toner layer.

Case 1 shown in FIG. 14A indicates a state in which the latent image support drum and the intermediate transfer medium belt most approach each other just after toner is transferred from the latent image support drum to the intermediate transfer medium belt. Case 2 shown in FIG. 14B indicates a state in which the latent image support drum and the intermediate transfer medium belt are set apart from each other as compared with Case 1 after the transfer.

In Case 1 just after toner is transferred, charge supplied by the transfer charger to the intermediate transfer medium belt is kept sufficient, thus an upward electric field toward the paper face in FIG. 14A is formed at both the left and right ends and the center of the toner layer and toner of negative charge receives a downward force, so that toner scattering does not occur.

On the other hand, in Case 2 in which the latent image support drum and the intermediate transfer medium belt are set apart from each other as compared with Case 1, the charge on the intermediate transfer medium belt diminishes by the time the state of Case 2 is reached after the transfer, whereby a downward electric field is formed from the upper layer to the lower layer at the center of the toner layer and a slantingly downward electric field is formed in the vicinity of the upper layer at both the left and right ends of the toner layer, as shown in FIG. 14B. Thus, toner in the vicinity of the upper layer at both the left and right ends of the toner layer receives an upward force. When the upward force that the toner receives increases exceeding a given limit, toner scattering occurs.

FIGS. 15A and 15B are graphs showing the electric field state in the gap between the latent image support drum and the intermediate transfer medium belt.

The horizontal axes of FIGS. 15A and 15B represent horizontal positions in FIGS. 14A and 14B on the uppermost layer face of a toner layer formed on the intermediate transfer medium belt in FIGS. 14A and 14B. The vertical axis of FIG. 15A represents the electric field strength and that of FIG. 15B represents the electric field directions.

The portion hatched in FIG. 15B indicates the range in which the electric field direction is a direction causing toner to scatter. Although the electric field direction is within the range, if the electric field strength is small (generally about several V/$\mu$m or less), toner scattering does not occur due to action of adhesion force of toner to each other, gravity, etc. As shown in FIGS. 15A and 15B, in Case 1, the electric field direction is almost $\pi/2$, namely, an upward direction perpendicular to the intermediate transfer medium belt surface (toner face); however, in case 2, the electric field direction is $-\pi/2$, reversed to a downward direction perpendicular to the intermediate transfer medium belt surface, and moreover the electric field strength increases as approaching the toner layer, and reaches about 10 V/$\mu$m in the toner layer portion, thus showing that in Case 2, toner receives strong action in the direction in which it easily scatters.

The above-mentioned toner scattering occurs remarkably in color image formation systems because toner images of multiple colors are overlapped on each other and the charge amount increases accordingly.

By the way, generally the following three causes of toner scattering are possible:

(1) When a gap exists between the latent image support and the transfer medium upstream in the transfer medium move direction from the transfer position, a transfer electric field acts on the gap, thus toner comes off the latent image support and moves to the transfer medium in the gap. At this time, if the electric field does not act in a direction almost perpendicular to the transfer medium, the toner moves in a horizontal direction to the transfer medium, causing toner scattering.

(2) Discharge occurs in a gap occurring when the transfer medium comes off the latent image support (strip-off discharge) and toner moves in the gap due to the discharge, causing toner scattering.

(3) Since toner layer holding charge diminishes after transfer as described above, toner charges repel one another, causing toner scattering.

Hitherto, various remedies against the three causes have been proposed.

For (1), a method for preventing a transfer electric field from acting upstream from a transfer position is available. For example, Japanese Patent Laid-Open No. Hei 3-267971 discloses a method of applying a bias reverse to a transfer bias upstream from a transfer position, thereby suppressing a transfer electric field. Japanese Patent Laid-Open No. Hei 4-186387 discloses a method of installing means for blocking an electric field turning upstream from a transfer position or weakening an electric field, thereby suppressing a transfer electric field and preventing toner from moving in a gap. Japanese Patent Laid-Open No. Hei 2-163779 discloses a method of installing a conductive cover for shielding an electric field between a latent image support drum and a transfer roller upstream and downstream from a transfer position. In color image formation systems with a transfer drum, a technique of providing a regulation plate upstream from a transfer corotron for preventing charge from flowing upstream from a transfer position is generally used.

For (2), a method of installing electricity removal means just after the transfer position for extinguishing the transfer electric field causing the strip-off discharge is generally used, and a plan for suppressing the strip-off discharge is also devised. For example, Japanese Utility Model Laid-Open No. Hei 1-57768 discloses a method of installing an electricity remover between a toner image support and recording medium transport means.

However, the remedies are all remedies for (1) or (2) and are not remedies against toner scattering as charge diminishes after transfer in (3).

SUMMARY OF THE INVENTION

It is therefore an object of the invention to provide an image formation system that can prevent a toner image transferred onto a transfer medium from scattering for providing a high-quality image.

To the end, according to the invention, there is provided a first image formation system comprising a latent image support on which a latent image is formed, means for forming a latent image on the latent image support, means for developing the latent image formed on the latent image support in toner, thereby forming a toner image on the latent image support, an intermediate transfer medium for receiving transfer of the toner image formed on the latent image support, first transfer means for transferring the toner image formed on the latent image support to the intermediate transfer medium, force giving means for causing a force in an attraction direction toward the intermediate transfer medium to act on the toner image transferred onto the intermediate transfer medium, second transfer means for transferring the toner image transferred onto the intermediate transfer medium onto a predetermined recording medium, and fuser means for fixing the toner image transferred onto the recording medium on the recording medium.

The second transfer means and the fuser means may be separate means; they may be a unit thereof for executing transfer and fixing.

To the end, according to the invention, there is provided a second image formation system comprising a latent image support on which a latent image is formed, means for forming a latent image on the latent image support, means for developing the latent image formed on the latent image support in toner, thereby forming a toner image on the latent image support, means for transferring the toner image formed on the latent image support directly onto a predetermined recording medium or once onto a predetermined intermediate transfer medium and then onto the predetermined recording medium at a predetermined transfer position, fuser means for fixing the toner image transferred to the recording medium on the recording medium at a predetermined fixing position, means for transporting the recording medium along a predetermined transport passage through the predetermined transfer position and the predetermined fixing position, and force giving means for causing a force in an attraction direction toward the recording medium to act on the toner image transferred onto the recording medium between the predetermined transfer position and the predetermined fixing position on the predetermined transport passage.

In both the first and second image formation systems, preferably toner for making the toner image supports charge and the force giving means is electric field giving means for causing an electric field to act on the toner image, thereby giving the force in the attraction direction to the toner image.

In both the first and second image formation systems, preferably toner for making the toner image is magnetic substance and the force giving means is magnetic field giving means for causing a magnetic field to act on the toner image, thereby giving the force in the attraction direction to the toner image.

Further, in the first image formation system, the intermediate transfer medium may be made of a material to allow air to pass therethrough, and the force giving means may be air suction means for sucking air passing through the intermediate transfer medium from the rear side of the surface of the intermediate transfer medium onto which the toner image is transferred, thereby causing the force in the attraction direction to act on the toner image.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Referring now to the accompanying drawings, there are shown preferred embodiments of the invention.

Figure 1:
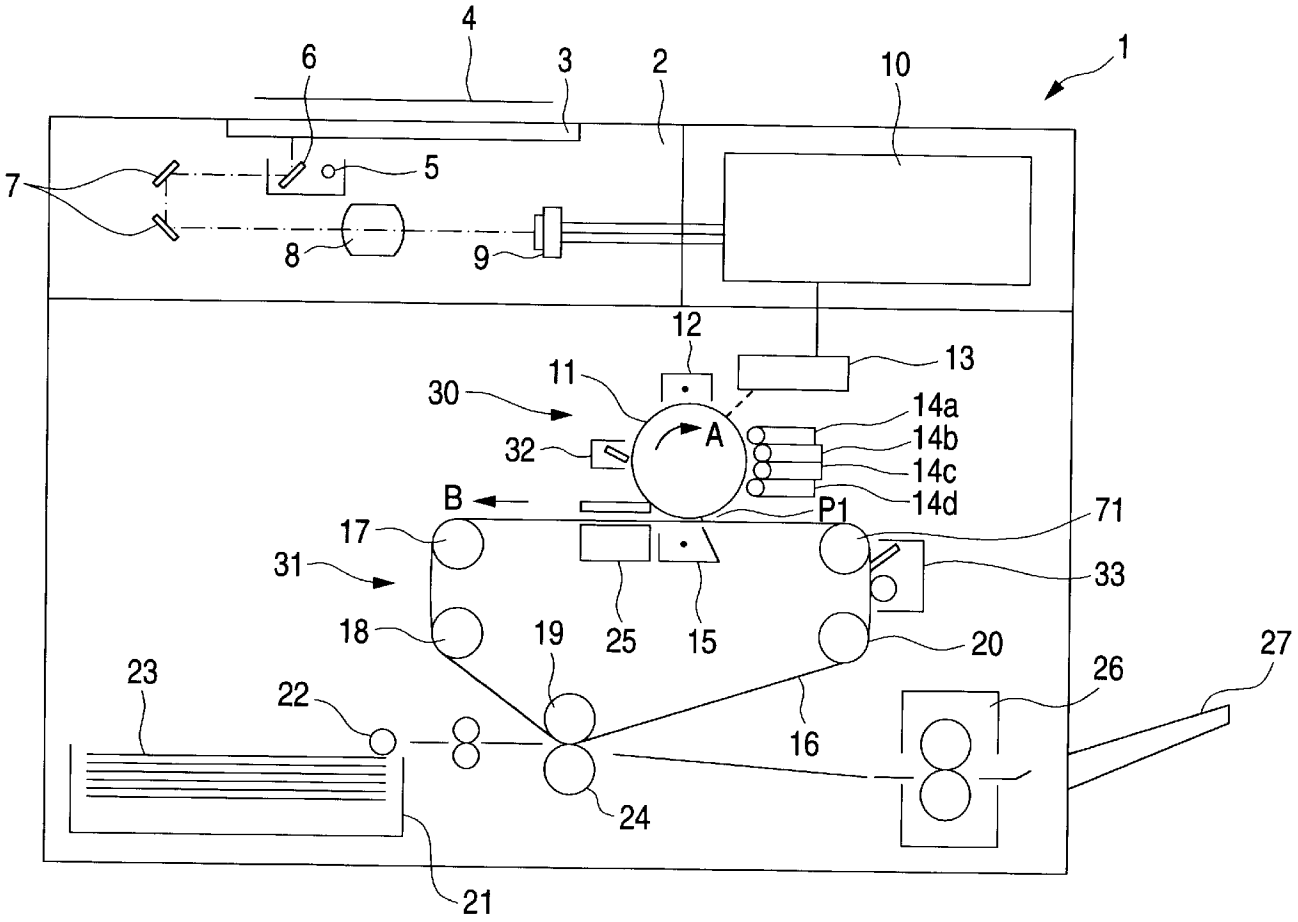
FIG. 1 is a schematic block diagram of a color image formation system to show one embodiment of a first image formation system of the invention.

FIG. 1 is a schematic block diagram of a color image formation system to show one embodiment of a first image formation system of the invention.

As shown here, an image read section 2 for reading an image of an original document 4 is placed on the top of a color image formation system main unit 1. It comprises platen glass 3, a light source 5, two scanning mirrors 6 and 7, an image formation lens 8, a color CCD sensor 9, etc. A reflected light image from the original document 4 placed on the platen glass 3 and illuminated by the light source 5 is read through the two scanning mirrors 6 and 7 and the image formation lens 8 by the CCD sensor 9 as RGB image signals.

The read RGB image signals are input to an image signal processing section 10 and are converted into YMCK image signals by the image signal processing section 10 and are temporarily stored in a memory provided in the image signal processing section 10 as required.

The color image formation system main unit 1 contains an image formation unit 30 and an intermediate transfer medium unit 31.

The image formation unit 30 comprises a drum-like latent image support drum 11 turning in the arrow A direction. The latent image support drum 11 is charged uniformly to a predetermined negative potential by a charger 12, then an electrostatic latent image is formed by a laser beam scanning section 13. The laser beam scanning section 13 radiates the latent image support drum 11 with a laser beam responsive to color image data of yellow (Y), magenta (M), cyan (C), and black (K) output in sequence from the image signal processing section 10, thereby exposing an image to light and resultantly forming an electrostatic latent image on the latent image support drum 11.

The electrostatic latent image formed on the latent image support drum 11 is developed by developing devices 14*a*, 14*b*, 14*c*, and 14*d* for forming yellow (Y), magenta (M), cyan (C), and black (K) color toner images respectively. Tone of the colors is charged negative and deposited on the area on the latent image support drum 11 radiated with the laser beam. Each time the latent image support drum 11 turns once, a toner image of one color is formed and when the latent image support drum 11 turns four times, toner images of four colors are formed.

The intermediate transfer medium unit 31 comprises an intermediate transfer medium belt 16 placed on a drive roll 71, a tension roll 17, idler rolls 18 and 20, and a secondary transfer backup roll 19. The intermediate transfer medium belt 16 is driven by the drive roll 71 and turns in the arrow B direction.

The intermediate transfer medium belt 16 uses a polycarbonate resin whose resistant value is adjusted to about volume resistance $10^{12}\Omega$cm, for example.

A transfer charger 15 is provided on the rear side of the intermediate transfer medium belt 16 at a first transfer position P1 where the intermediate transfer medium belt 16 faces the latent image support drum 11 for supplying positive charge to the intermediate transfer medium belt 16. A toner image on the latent image support drum 11 is transferred onto the intermediate transfer medium belt 16 by the action of the charge on the intermediate transfer medium belt 16. Each time a 1-color toner image is formed, it is transferred, and each time the intermediate transfer medium belt 16 makes a round, a toner image of a different color is overlapped on the toner image already transferred onto the intermediate transfer medium belt 16 in sequence.

A paper feed cassette 21 for storing recording media 23 and a fuser 26 are disposed on the bottom of the image formation system main unit 1.

After toner images of four colors are transferred onto the intermediate transfer medium belt 16, the intermediate transfer medium belt 16 furthermore turns for moving the toner images of four colors to a second transfer point P2. In synchronization with the toner images of four colors arriving at the second transfer point P2, one of the recording media 23 stored in the paper feed cassette 21 is fed by a paper feed roll 22 and is transferred to the second transfer position P2.

At the second transfer position P2, a secondary transfer roll 24 is disposed facing the secondary transfer backup roll 19 for supplying positive charge to the recording medium 23. Toner image on the intermediate transfer medium belt 16 is electrostatically transferred onto the recording medium 23 by the action of the charge on the recording medium 23.

The recording medium 23 onto which the toner image is transferred undergoes a fixing treatment by heat and under pressure by the fuser 26, then is discharged to a tray 27. The color image formation cycle is now complete.

Residues on the surface of the latent image support drum 11 completing the transfer at the first transfer position P1 are removed by a cleaner 32, and the latent image support drum 11 makes the transition to the next image formation cycle.

On the other hand, residues on the surface of the intermediate transfer medium belt 16 completing the transfer at the second transfer position P2 are removed by a cleaner 33, and the intermediate transfer medium belt 16 makes the transition to the next image formation cycle.

The intermediate transfer medium unit 31 is provided with electric field giving means 25 adjacent to the transfer charger 15 downstream from the first transfer position P1. The electric field giving means 25 forms an electric field in a direction from the rear side of the intermediate transfer medium belt 16 toward the surface side thereof for giving a force to the toner image transferred onto the intermediate transfer medium belt 16 in a direction in which the toner image is attracted to the intermediate transfer medium belt 16. That is, the electric field giving means 25 causes a force in the attraction direction toward the intermediate transfer medium belt 16 to act on the toner image transferred onto the intermediate transfer medium belt 16, thereby suppressing toner scattering. The electric field giving means will be discussed later in detail.

Next, an embodiment of a second image formation system of the invention will be discussed.

Figure 2:
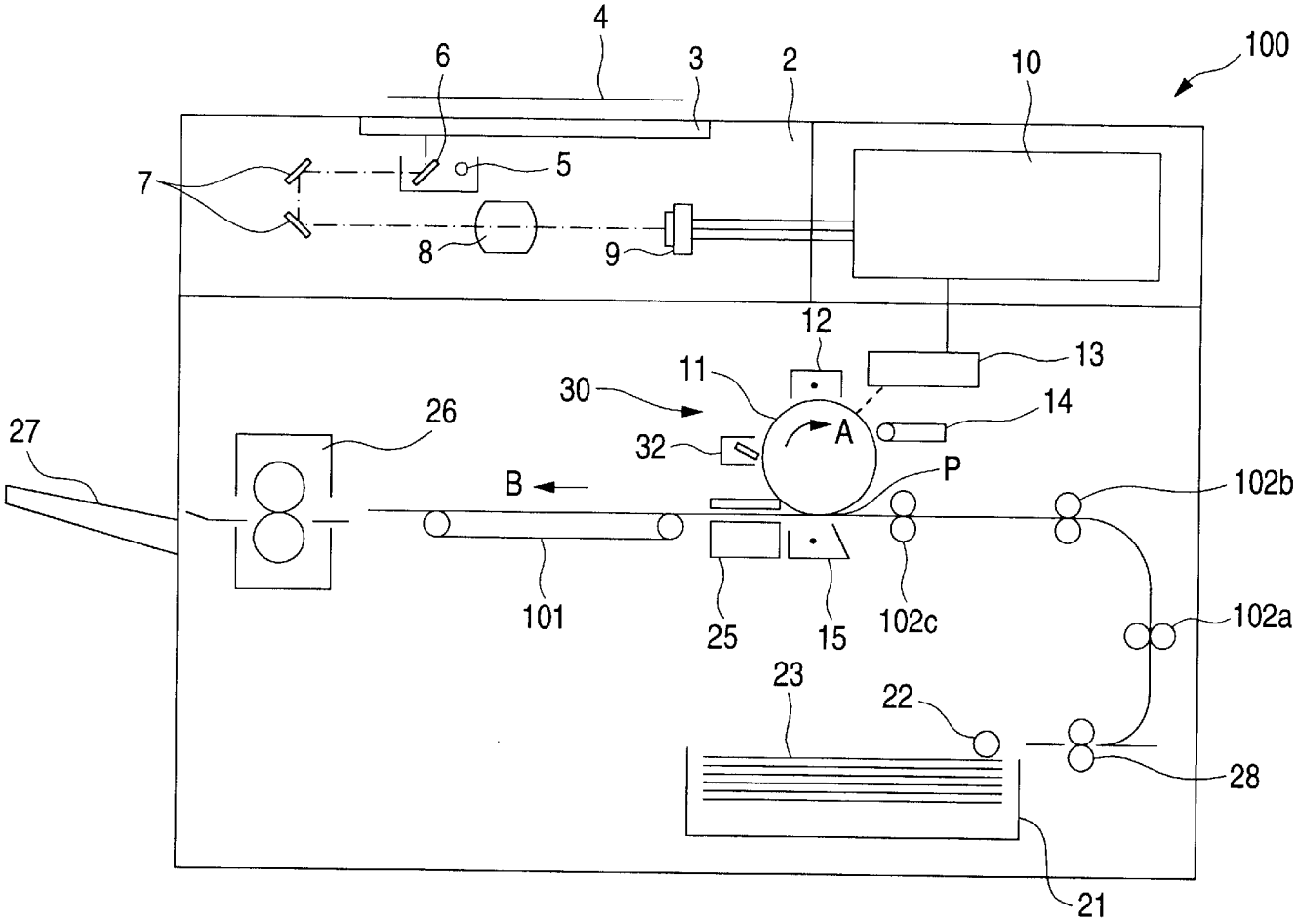
FIG. 2 is a schematic block diagram to show one embodiment of a second image formation system of the invention.

FIG. 2 is a schematic block diagram to show the embodiment of the second image formation system of the invention.

As shown here, an image formation system main unit 100 is an image formation system for forming a monochrome image. It basically differs from the color image formation system main unit 1 previously described with reference to FIG. 1 in composition on and after the transfer step; they are almost the same in composition before the transfer step. That is, an image read section 2, an image signal processing section 10, and an image formation unit 30 disposed on the top of the image formation system main unit 100 are almost the same as those of the color image formation system main unit 1.

Therefore, the composition and operation before the transfer step will not be discussed again, and the composition and operation of the image formation system main unit 100 on and after the transfer step will be discussed.

At a transfer position P of a latent image support drum 11, a transfer charger 15 is disposed facing the latent image support drum 11, and electric field giving means 25 is disposed adjacent to the transfer charger 15 downstream from the transfer position P.

In addition, a paper feed cassette 21 for storing recording media 23, a regist roll 28, paper transport rolls 102*a*–102*c*, a paper transporter 101, and a fuser 26 are disposed on the bottom of the image formation system main unit 100.

In synchronization with a toner image formed on the latent image support drum 11 reaching the transfer position P as the latent image support drum 11 turns, one of the recording media 23 is taken out from the paper feed cassette 21 by a feed roll 22 and is transported via the regist roll 28 and the paper transport rolls 102*a*–102*c* to the transfer position P.

The transfer charger 15 disposed on the rear side of the transport passage of the recording medium 23 at the transfer position P supplies positive charge to the recording medium 23, and toner image on the latent image support drum 11 is transferred onto the recording medium 23 by the action of the charge on the recording medium 23.

The recording medium 23 upon completion of the transfer is transported to the fuser 26 in the arrow B direction by the paper transporter 101 disposed downstream from the transfer position P and the toner image transferred onto the recording medium 23 undergoes a fixing treatment by heat and under pressure by the fuser 26, then is discharged to a tray 27. The color image formation cycle is now complete.

Residues on the surface of the latent image support drum 11 completing the transfer at the transfer position P are removed by a cleaner 32, and the latent image support drum 11 makes the transition to the next image formation cycle.

The electric field giving means 25 disposed downstream from the transfer position P forms an electric field in a direction from the rear side of the recording medium 23 toward the surface side thereof for giving a force to the toner image transferred onto the recording medium 23 in a direction in which the toner image is attracted to the recording medium 23. That is, the electric field giving means 25 causes a force in the attraction direction toward the recording medium 23 to act on the toner image transferred onto the recording medium 23, thereby preventing toner from scattering.

In the second embodiment of the invention, the toner image formed on the latent image support is directly transferred onto the recording medium; the second image formation system of the invention, namely, the image formation system comprising force giving means for giving a force to the toner image transferred onto the recording medium is not limited to an image formation system for transferring a toner image formed on a latent image support directly onto a recording medium and can also be applied to an image formation system for once transferring a toner image formed on a latent image support directly onto a predetermined intermediate transfer medium and then transferring it onto a predetermined recording medium. In this case, force giving means for causing a force in the attraction direction toward the recording medium to act on the toner image is provided between the position at which the toner image once transferred onto the intermediate transfer medium is transferred onto the recording medium and the position at which it is fixed.

Both the first and second image formation systems of the invention may be applied to an image formation system comprising an intermediate transfer medium for causing a force toward the intermediate transfer medium to act on the toner image once transferred onto the intermediate transfer medium and also causing a force toward a recording medium to act on the toner image transferred from the intermediate transfer medium onto the recording medium.

Next, various forms of the force giving means provided for the first or second image formation system of the invention will be discussed.

Figure 3:
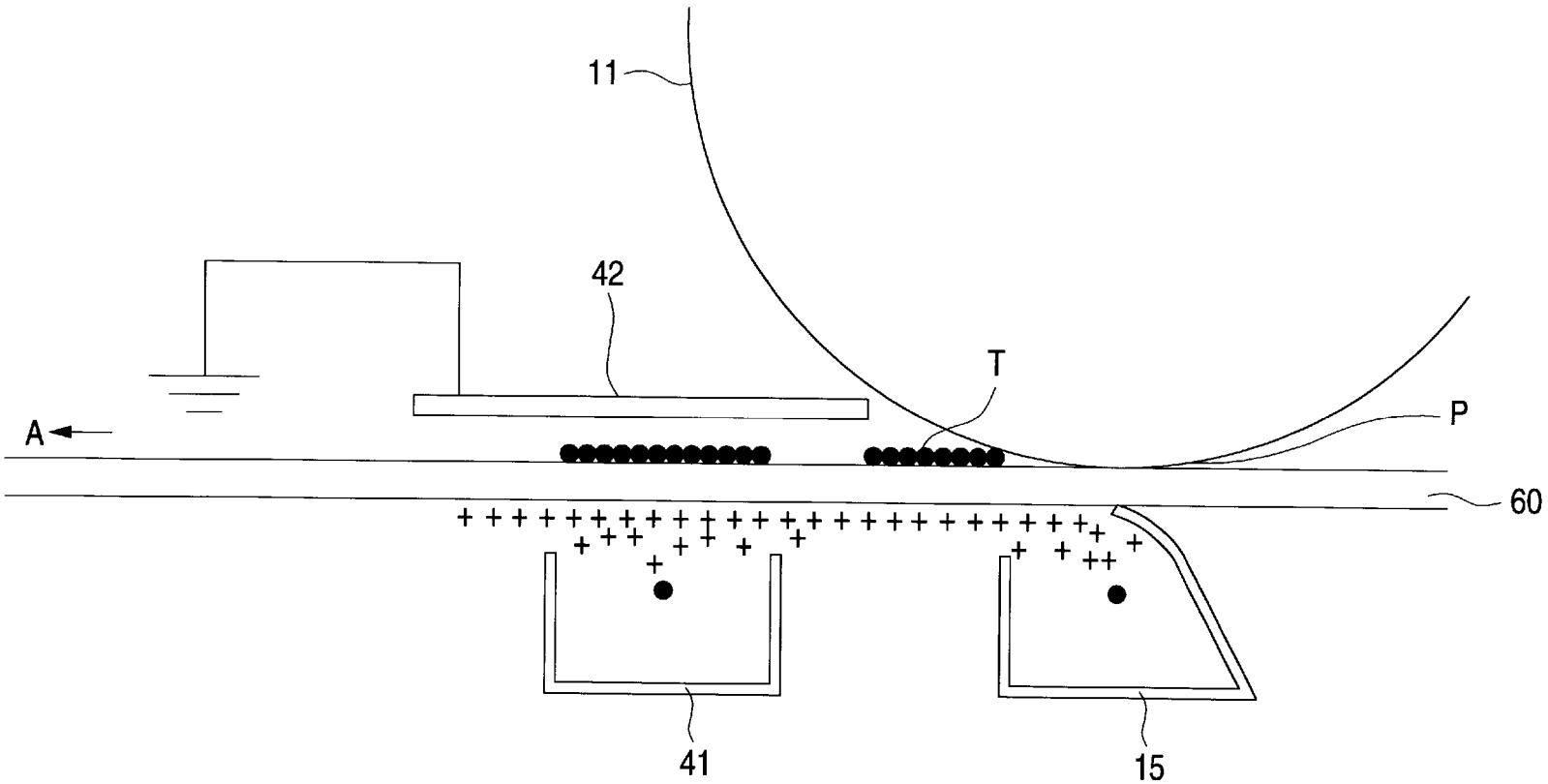
FIG. 3 is a schematic block diagram to show a first form of force giving means.

FIG. 3 is a schematic block diagram to show a first form of the force giving means.

As shown here, at transfer position P, the latent image support drum 11 and the transfer charger 15 face each other with a transfer medium 60 such as a recording medium or an intermediate transfer medium moving in the arrow A direction between. An auxiliary charger 41 is disposed adjacent to the transfer charger 15 downstream from the transfer position P. A counter electrode 42 grounded is disposed on the opposite side to the position of the auxiliary charger 41 with the transfer medium 60 between. The auxiliary charger 41 supplies charge of the same polarity as the transfer charger 15 to the transfer medium 60 and an upward electric field is formed between the charge and the counter electrode 42.

Thus, the auxiliary charger 41 and the counter electrode 42 serve as force giving means for causing a force in the attraction direction toward the transfer medium 60 to act on the toner image on the transfer medium 60, whereby toner is prevented from scattering.

Figure 4B:
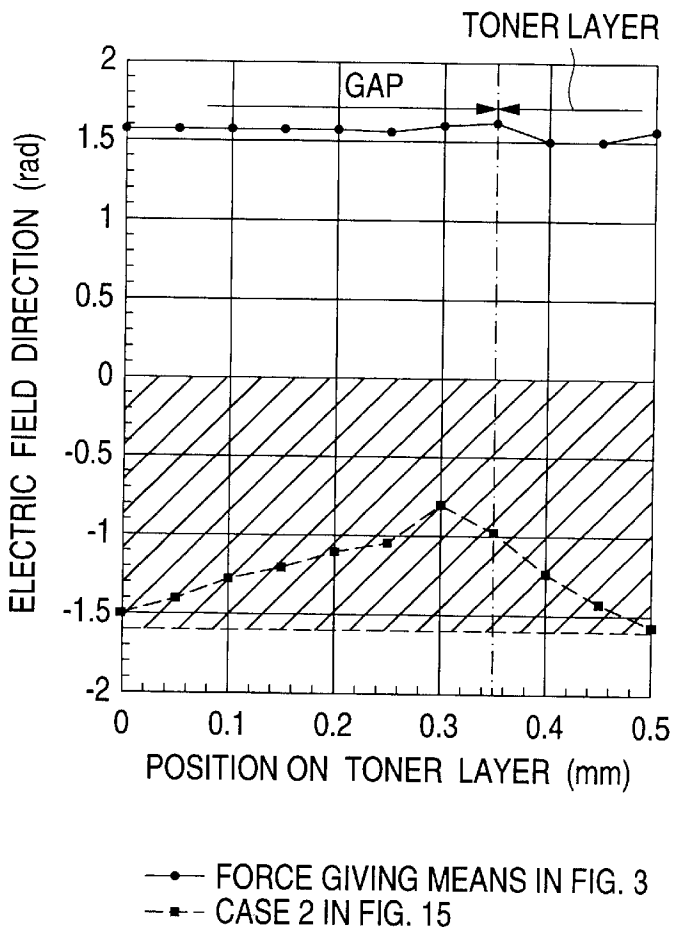
FIGS. 4A and 4B are graphs to show the electric field state in a gap between the latent image support drum and the intermediate transfer medium belt of the force giving means shown in FIG. 3.
Figure 4A:
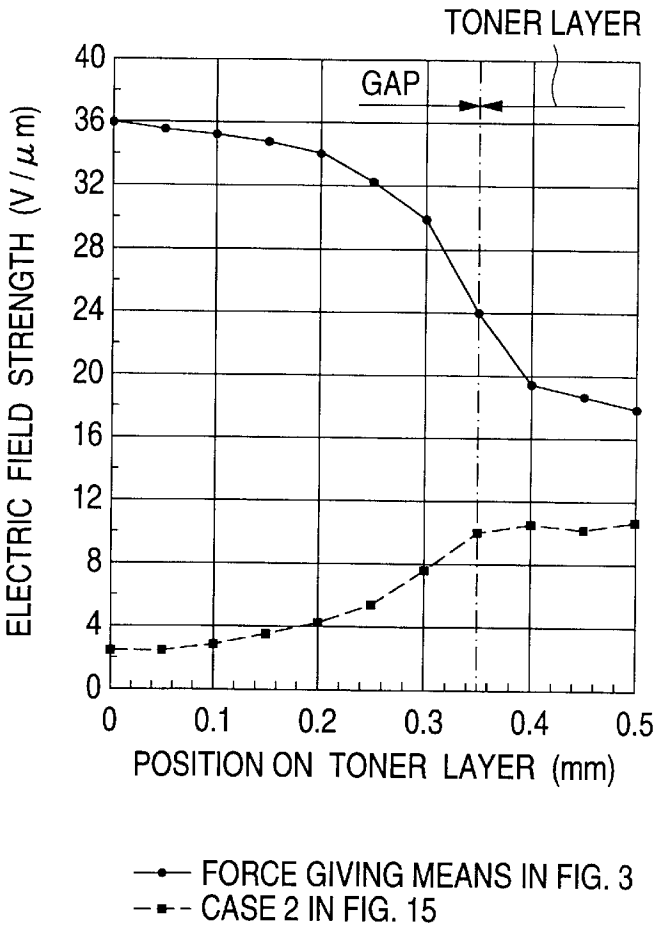

FIGS. 4A and 4B are graphs showing the electric field state in a gap between the latent image support drum and the intermediate transfer medium belt of the force giving means shown in FIG. 3.

Figure 15B:
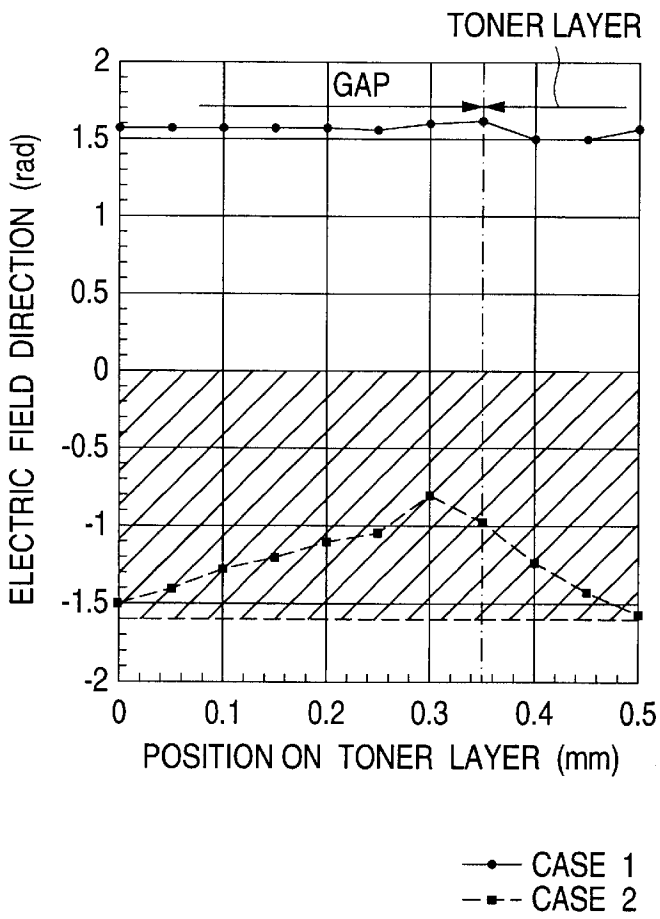
FIGS. 15A and 15B are graphs to show the electric field state in the gap between the latent image support drum and the intermediate transfer medium belt.
Figure 15A:
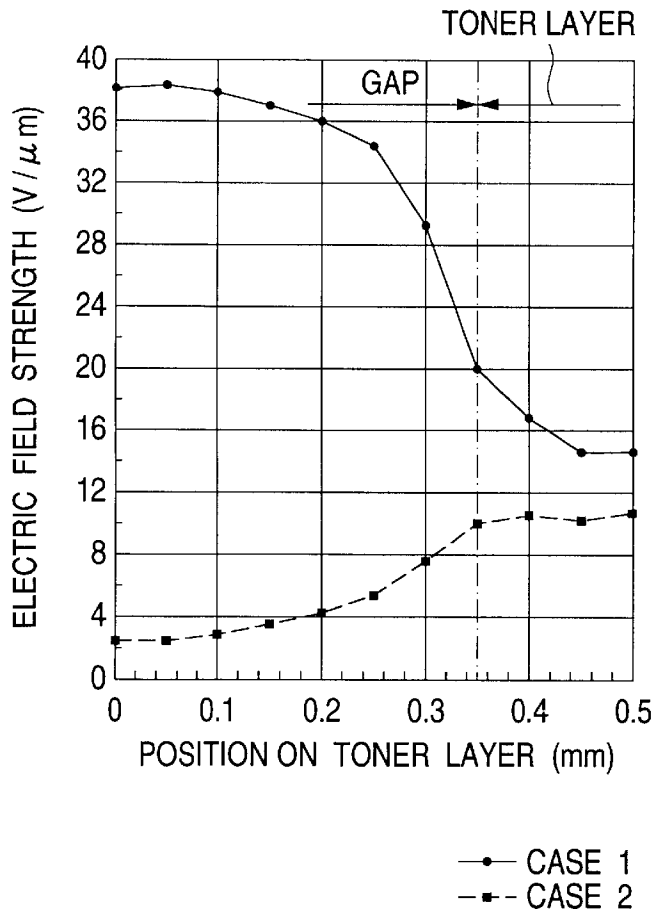

As in FIGS. 15A and 15B, the horizontal axis of FIGS. 4A and 4B represents positions on the face of the uppermost toner layer and the vertical axis represents the electric field strength and the electric field directions.

The curves indicated by solid lines in FIG. 4A and 4B are the electric field strength and directions at the position of the auxiliary charger 41 shown in FIG. 3. The curves indicated by broken lines are the electric field strength and directions in Case 2 in FIGS. 15A and 15B shown for reference.

As shown with the solid line curve in FIGS. 4A and 4B, the auxiliary charger 41 and the counter electrode 42 are provided, whereby the electric field direction becomes upward and a force in the attraction direction to the transfer medium 60 acts on the toner image on the transfer medium 60, preventing toner from scattering.

Figure 5:
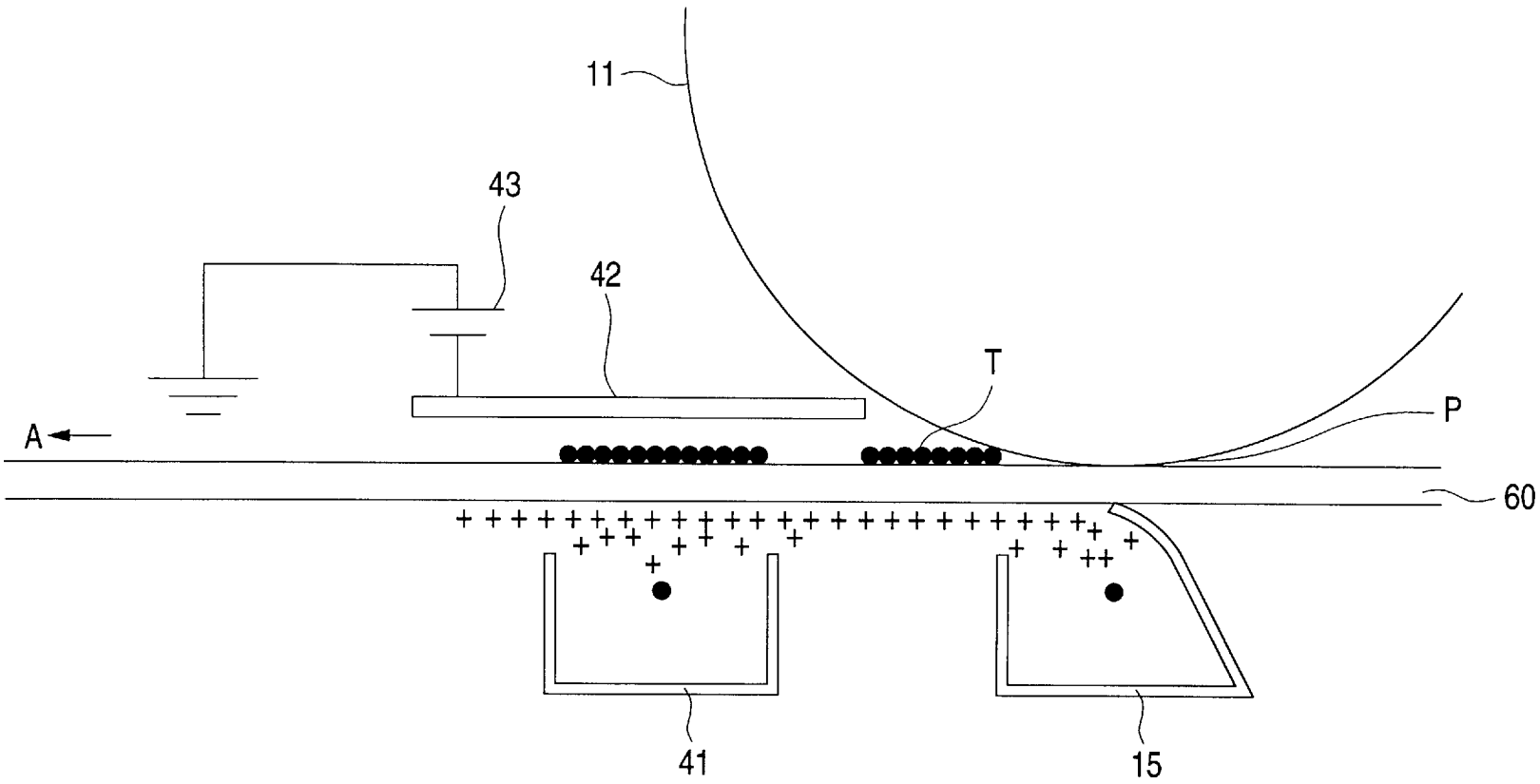
FIG. 5 is a schematic block diagram to show a second form of force giving means.

FIG. 5 is a schematic block diagram to show a second form of the force giving means.

The force giving means comprises a power supply 43 for applying a bias voltage added to the counter electrode 42 in the force giving means shown in FIG. 3. As shown in FIG. 5, the auxiliary charger 41 is disposed adjacent to the transfer charger 15 downstream from the transfer position P where the latent image support drum 11 and the transfer charger 15 face each other with the transfer medium 60 moving in the arrow A direction between. Further, the counter electrode 42 is disposed at the opposite position to the position of the auxiliary charger 41 with the transfer medium 60 between.

The power supply 43 for applying a bias voltage is connected to the counter electrode 42. A bias of the same polarity as toner T is applied from the power supply 43 to the counter electrode 42, so that the upper electric field is furthermore strengthened and the toner scattering prevention effect of the force giving means with the auxiliary charger 41 and the counter electrode 42 is furthermore enhanced. In some cases, the bias voltage applied to the auxiliary charger 41 can also be relatively lessened by applying the bias to the counter electrode 42. Thus, bias voltage may be applied to the counter electrode 42, thereby furthermore enhancing the effect of the auxiliary charger.

Figure 6:
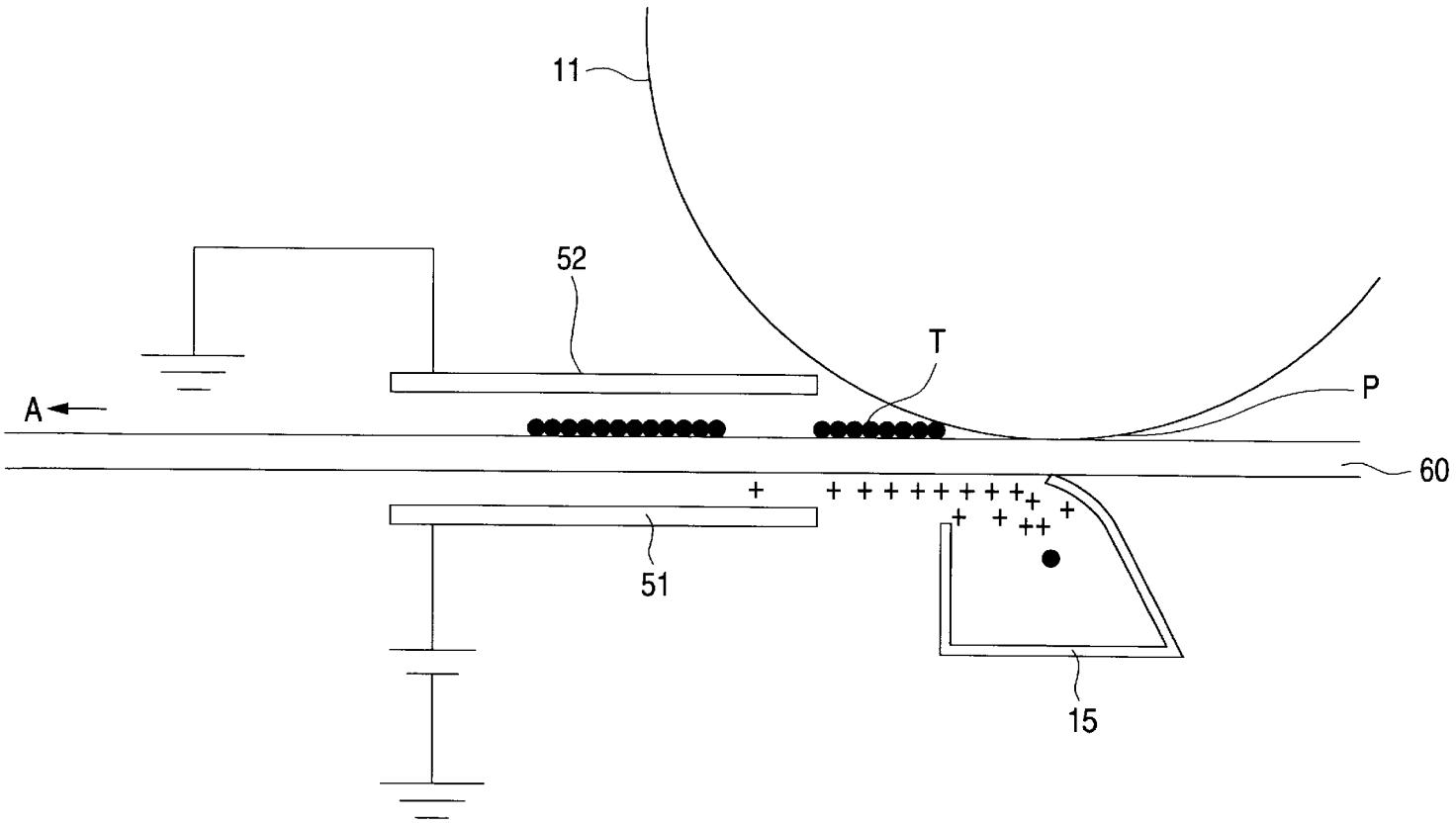
FIG. 6 is a schematic block diagram to show a third form of force giving means.

FIG. 6 is a schematic block diagram to show a third form of the force giving means.

As shown here, a rear side electrode 51 positively charged is disposed adjacent to the transfer charger 15 downstream from the transfer position P where the latent image support drum 11 and the transfer charger 15 face each other with the transfer medium 60 moving in the arrow A direction between. Further, a surface side electrode 52 is disposed at the opposite position to the position of the rear side charger 51 with the transfer medium 60 between.

If toner used is of a negative polarity, the potential of the surface side electrode 52 is set lower than that of the rear side electrode 51 (if toner used is of a positive polarity, the potential of the surface side electrode 52 is set higher than that of the rear side electrode 51). An electric field is formed in a direction from the rear side electrode 51 to the surface side electrode 52.

Thus, the rear side electrode 51 and the surface side electrode 52 serve as force giving means for causing a force in the attraction direction toward the transfer medium 60 to act on the toner image on the transfer medium 60, whereby toner is prevented from scattering.

Figure 7B:
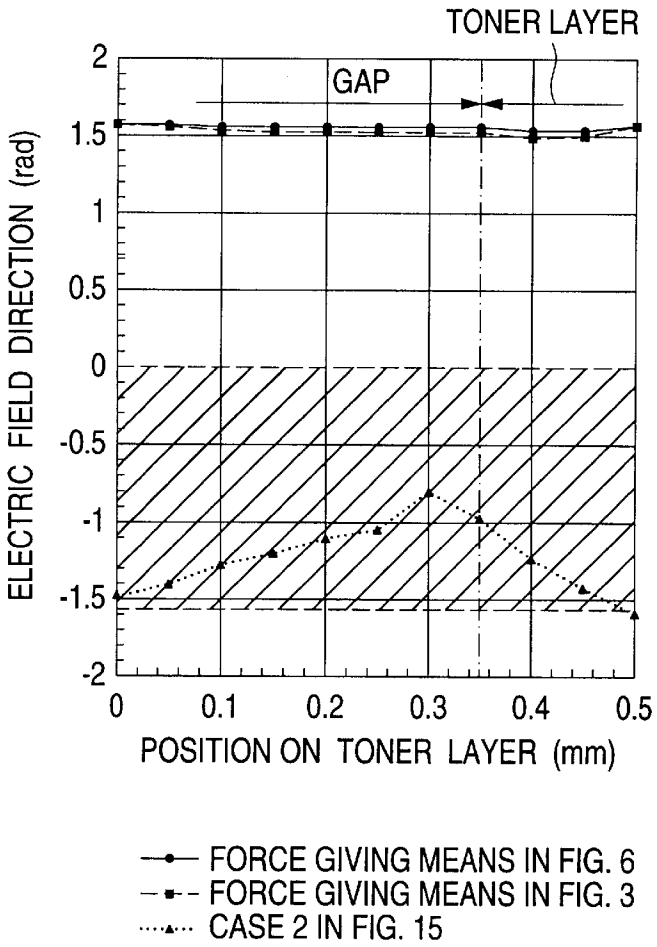
FIGS. 7A and 7B are graphs to show the electric field state in a gap between the latent image support drum and the intermediate transfer medium belt of the force giving means shown in FIG. 6.
Figure 7A:
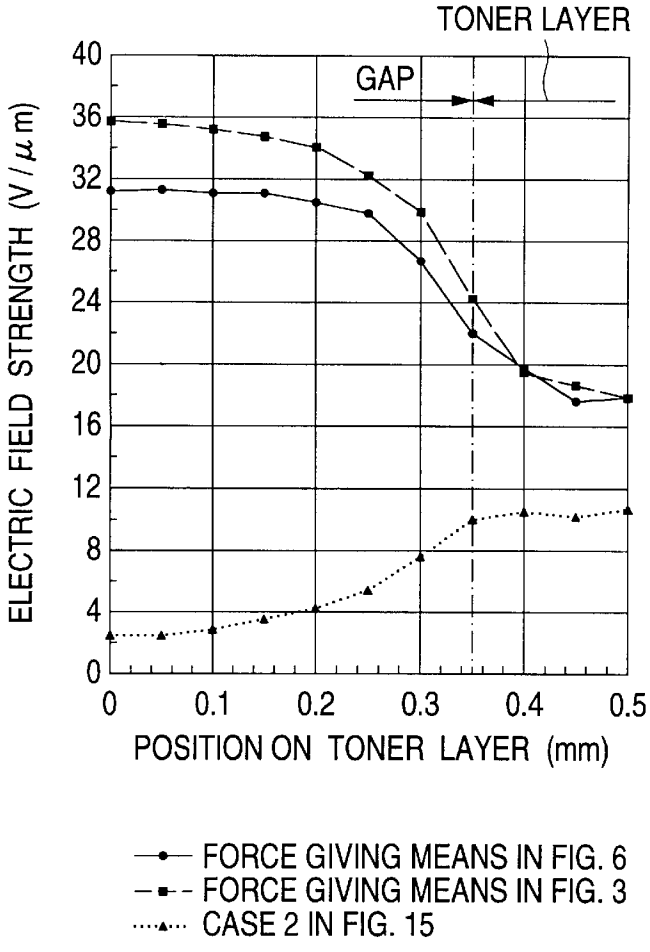

FIGS. 7A and 7B are graphs showing the electric field state in a gap between the latent image support drum and the intermediate transfer medium belt of the force giving means shown in FIG. 6.

As in FIGS. 15 and 4, the horizontal axis of FIGS. 7A and 7B represents positions on the face of the uppermost toner layer and the vertical axis represents the electric field strength and the electric field directions.

The curves indicated by solid lines in FIGS. 7A and 7B are the electric field strength and directions when the force giving means shown in FIG. 6 is used. The curves indicated by broken lines are the electric field strength and directions in the force giving means shown in FIG. 3. The curves indicated by dotted lines are the electric field strength and directions in Case 2 in Figure shown for reference.

As shown with the solid line curve in FIGS. 7A and 7B, the rear side electrode 51 and the front side electrode 52 are provided, whereby the electric field direction becomes upward, preventing toner from scattering, as in the force giving means in FIG. 3.

Like the force giving means in FIG. 5, the force giving means in FIG. 6 can also be provided with a power supply, whereby a bias of the same polarity as toner T can be applied to the surface side electrode 52 for furthermore strengthening the upper electric field. The bias voltage applied to the rear side electrode 51 can also be relatively lessened by applying the bias to the surface side electrode 52.

Figure 8:
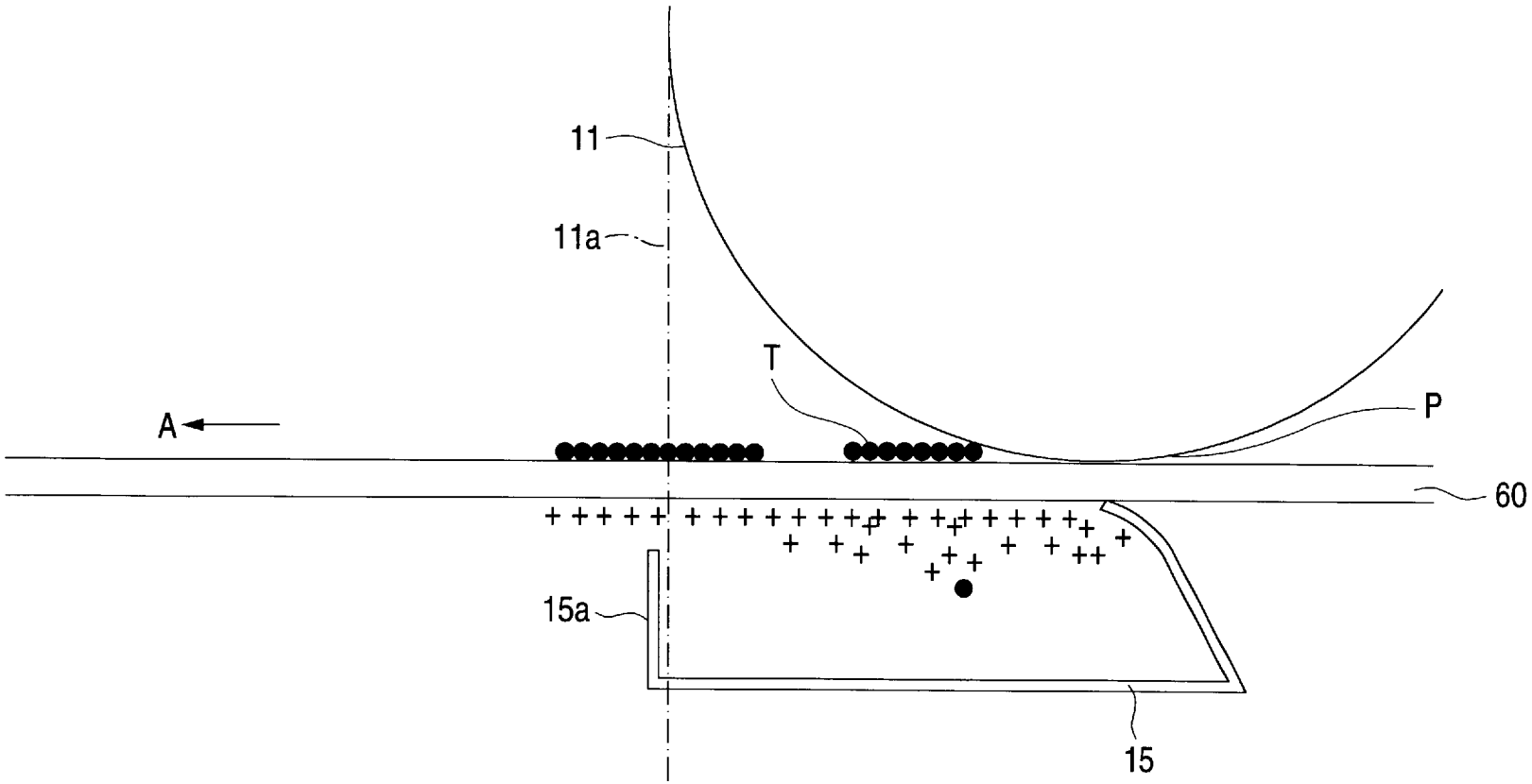
FIG. 8 is a schematic block diagram to show a fourth form of force giving means.

FIG. 8 is a schematic block diagram to show a fourth form of the force giving means.

As shown here, a transfer charger 15 having a width in a direction crossing the transfer medium move direction about 1.5 times the normal width is disposed downstream from the transfer position P where the toner image on the latent image support drum 11 is transferred onto the transfer medium 60 moving in the arrow A direction.

The transfer charger 15 is thus widened, whereby it may also serve as a function of the force giving means for causing a force in the attraction direction toward the transfer medium 60 to act on the toner image T transferred onto the latent image support drum 11.

The transfer current value is adjusted to a proper value in the force giving means in FIG. 8, whereby almost the same effect as the force giving means in FIG. 3 can be produced.

In this case, for the length in the length direction of the transfer charger 15 also serving as the force giving means, preferably a downstream shield 15*a* of the transfer charger 15 extends at least beyond a projection line 11*a* of the outer peripheral surface of the latent image support drum 11 onto the transfer medium 60.

Figure 9:
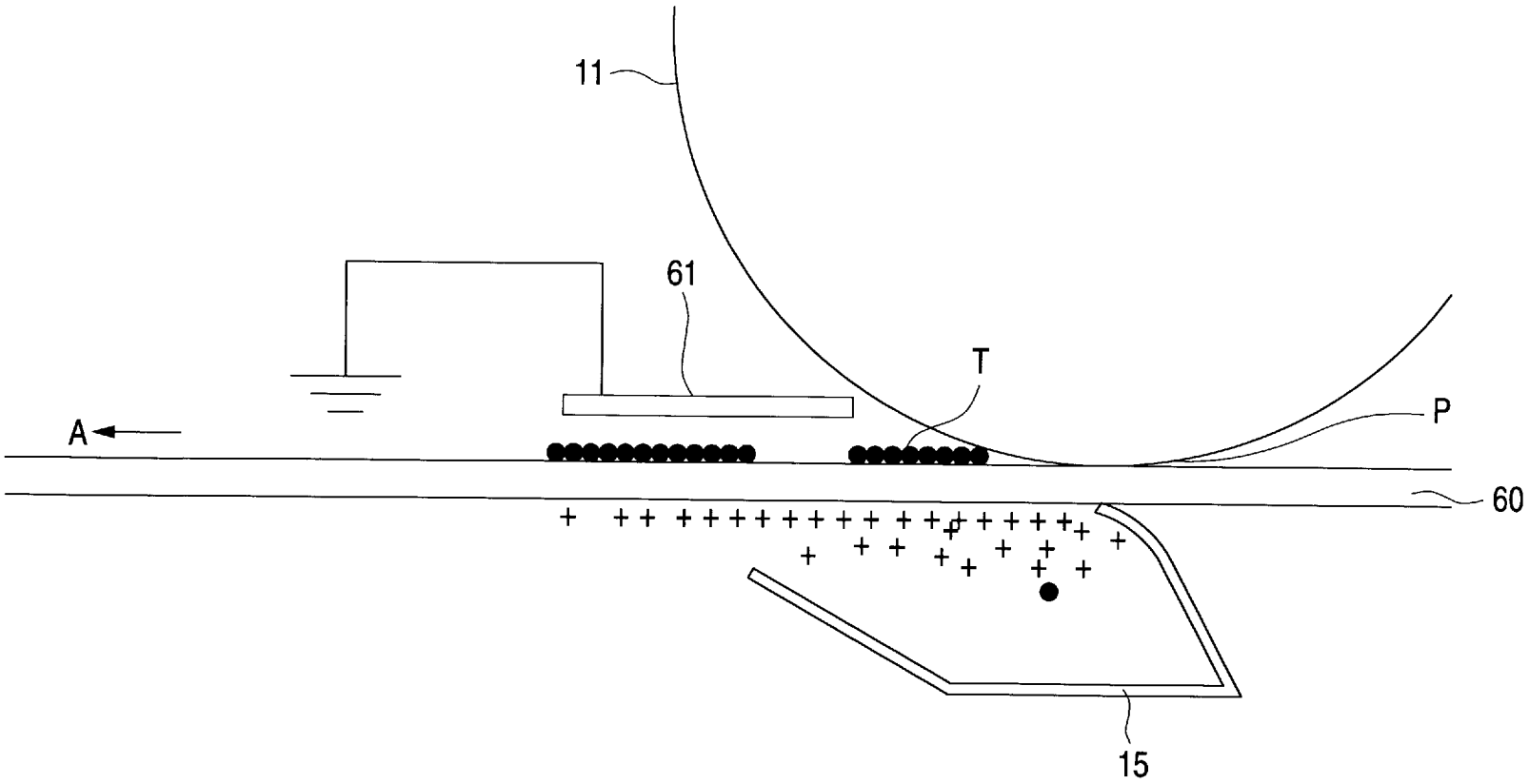
FIG. 9 is a schematic block diagram to show a fifth form of force giving means.

FIG. 9 is a schematic block diagram to show a fifth form of the force giving means.

As shown here, a counter electrode 61 grounded is disposed downstream from the transfer position P where the latent image support drum 11 and the transfer charger 15 face each other with the transfer medium 60 moving in the arrow A direction between, whereby charge from the transfer charger 15 is efficiently supplied to the transfer medium 60 downstream from the transfer position P, and almost the same effect as the surface electrode 52 in the force giving means shown in FIG. 6 can be produced.

Figure 10:
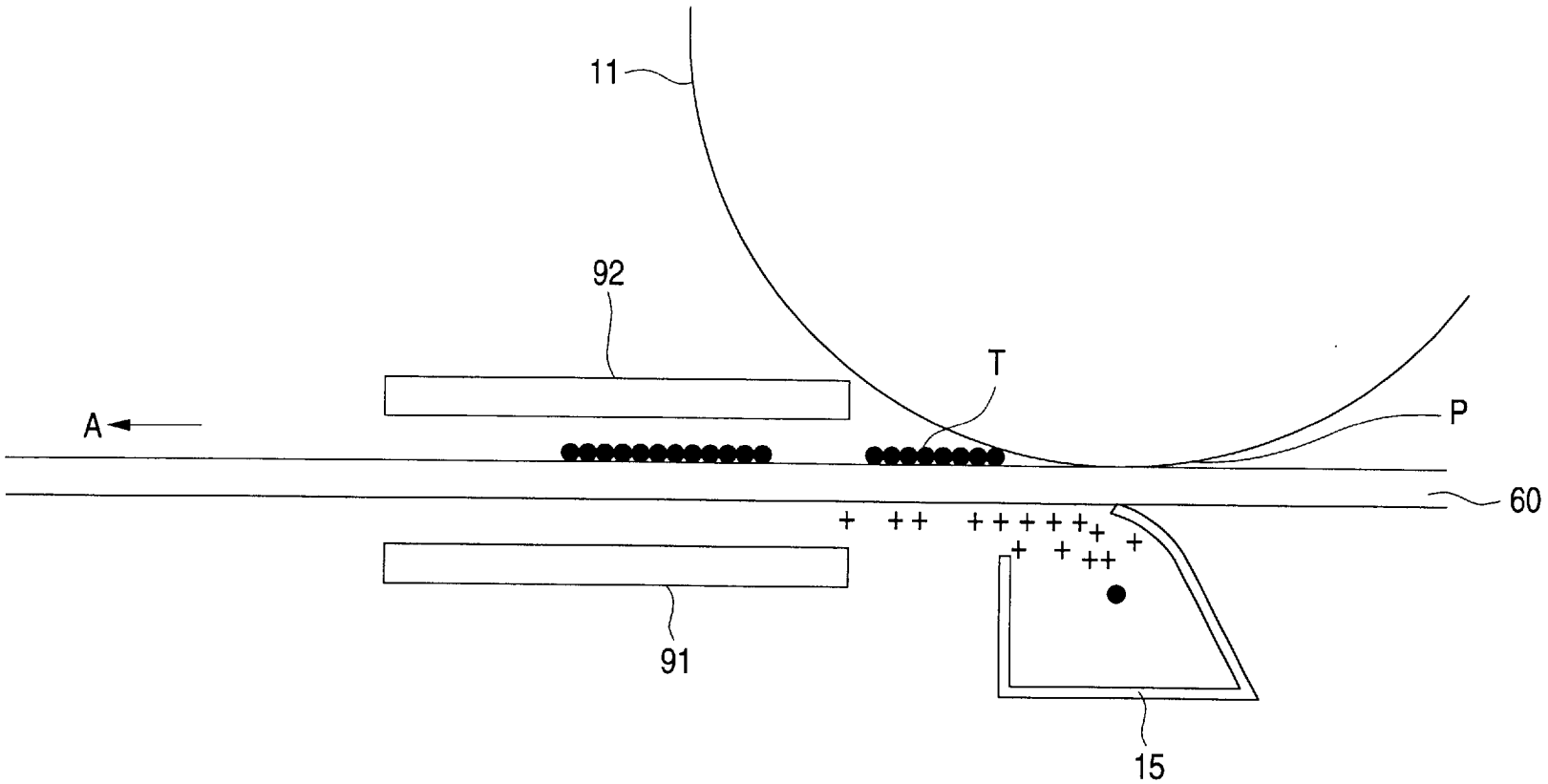
FIG. 10 is a schematic block diagram to show a sixth form of force giving means.

FIG. 10 is a schematic block diagram to show a sixth form of the force giving means.

The force giving means is an example for forming images by using magnetic toner as toner for forming toner image T. As shown in FIG. 10, a magnet 91 is disposed adjacent to the transfer charger 15 downstream from the transfer position P where the latent image support drum 11 and the transfer charger 15 face each other with the transfer medium 60 moving in the arrow A direction between. Further, a magnet 92 is disposed at the opposite position to the magnet 91 with the transfer medium 60 between. A magnetic field formed by the pair of magnets 91 and 92 causes a force in the attraction direction toward the transfer medium 60 to act on magnetic toner image T transferred onto the transfer medium 60, so that toner is prevented from scattering.

Figure 11:
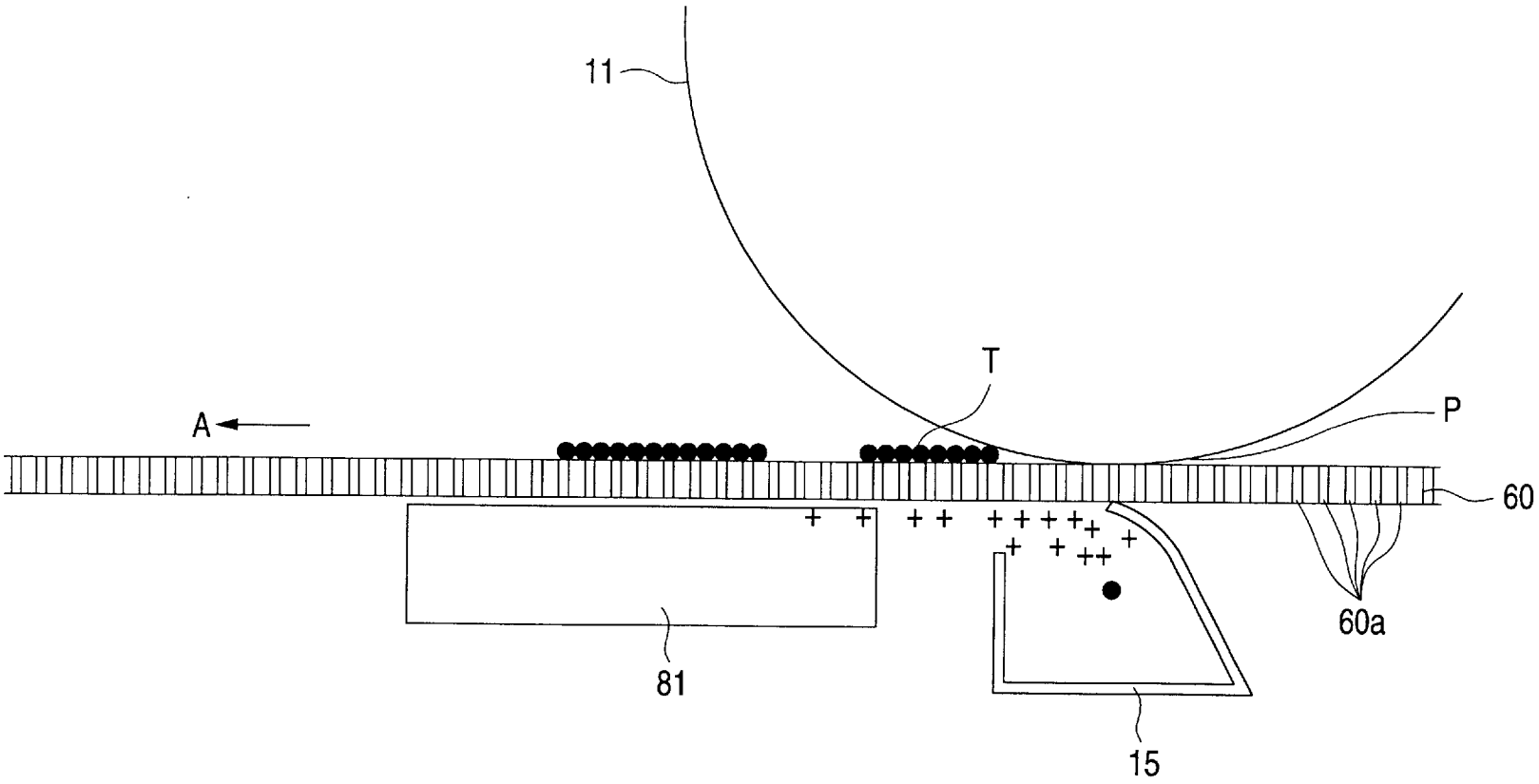
FIG. 11 is a schematic block diagram to show a seventh form of force giving means.
Figure 12:
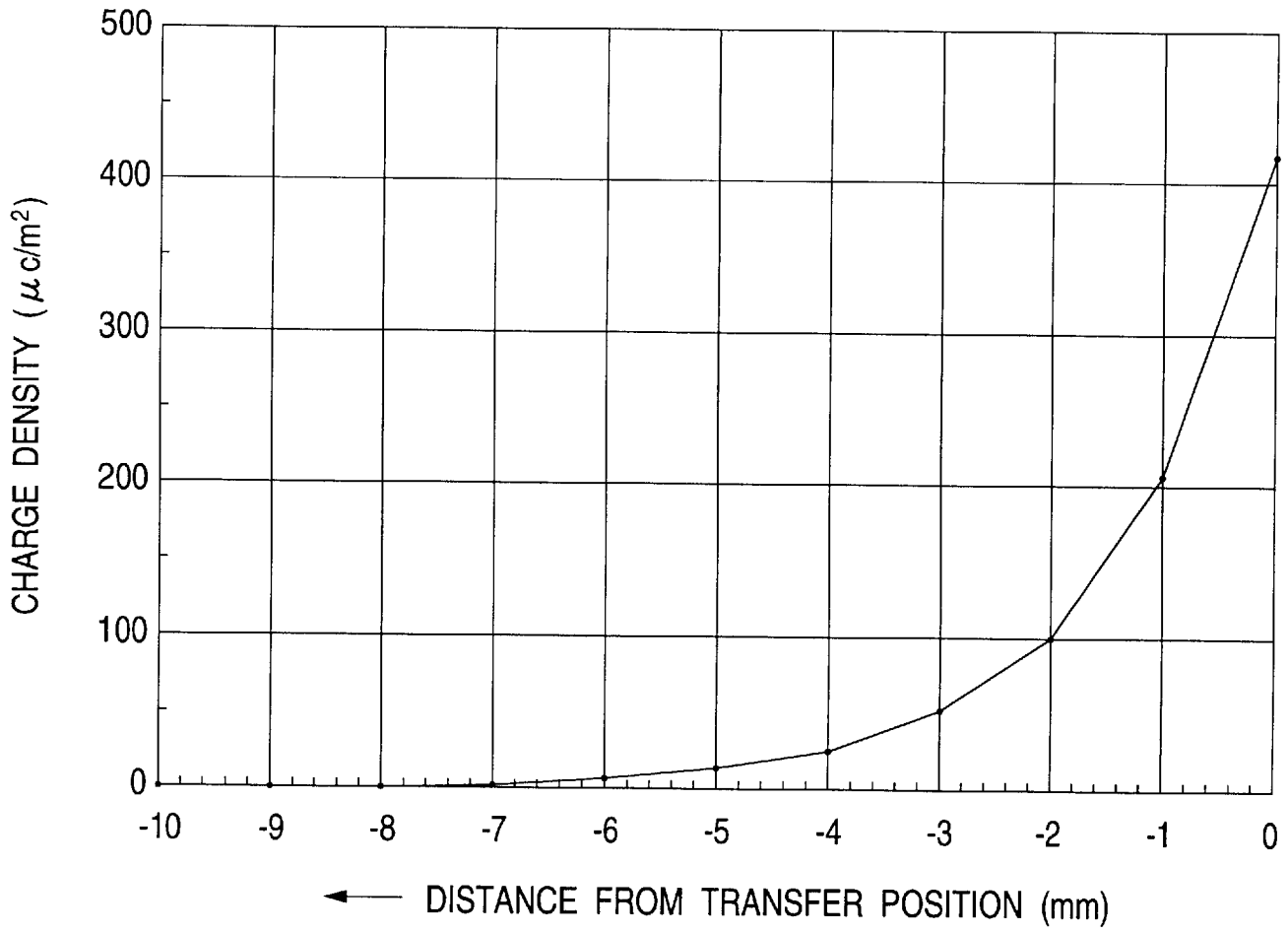
FIG. 12 is a graph to show a diminishing state of charge supplied to a semiconductive intermediate transfer medium.
Figure 13:
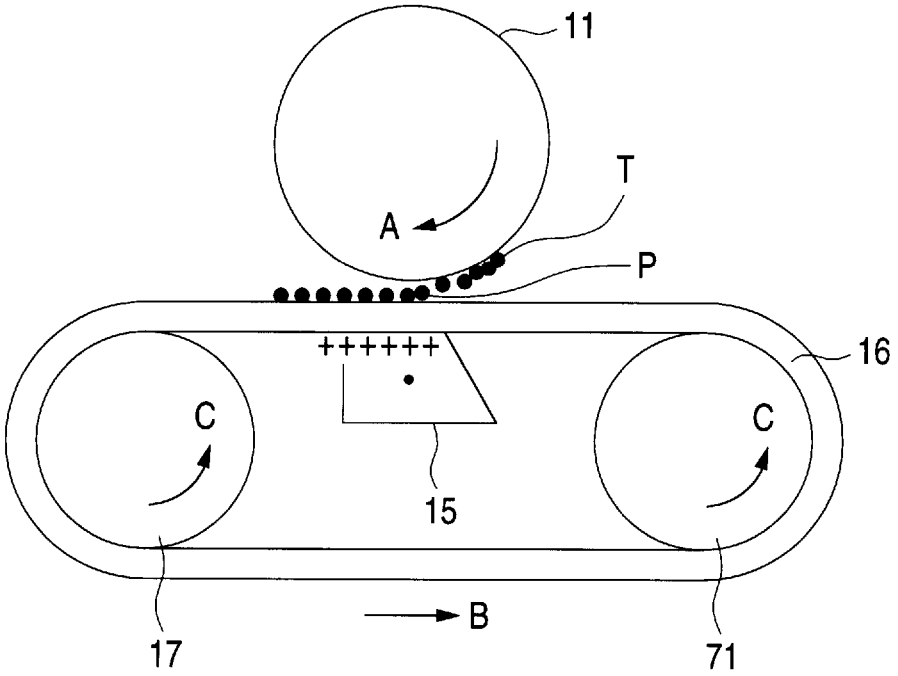
FIG. 13 is a schematic diagram of an image formation system adopting a intermediate transfer system according to piror art.
Figure 14A:
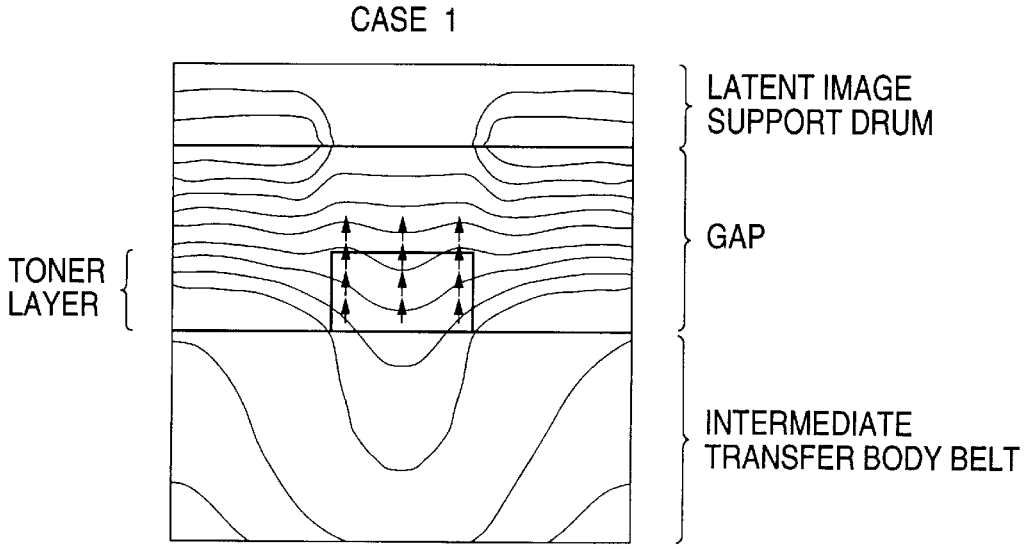
FIGS. 14A and 14B are diagrammatic illustrations showing change of a potential distribution and an electric field distribution associated with change of a gap between a latent image support drum and an intermediate transfer medium belt.
Figure 14B:
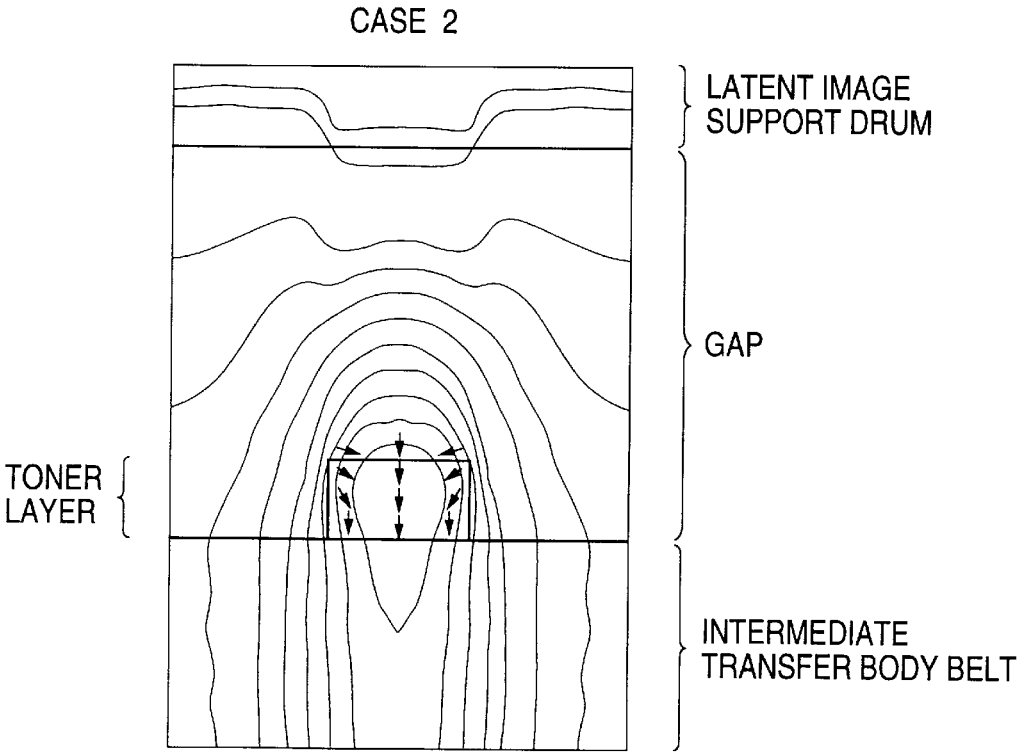

FIG. 11 is a schematic block diagram to show a seventh form of the force giving means.

As shown in FIG. 11, air suction means 81 is disposed adjacent to the transfer charger 15 downstream from the transfer position P where the latent image support drum 11 and the transfer charger 15 face each other with the transfer medium 60 moving in the arrow A direction between.

The transfer medium 60 in the force giving means is limited to an intermediate transfer medium such as an intermediate transfer medium belt and does not include recording media such as paper. The transfer medium (intermediate transfer medium) is made of a breathing material having an unlimited number of fine holes 60*a* to allow air to path through.

The air suction means 81 sucks air passing through the transfer medium 60 from the rear side of the face of the transfer medium 60 onto which toner image T is transferred, thereby causing a force in the attraction direction toward the transfer medium 60 to act on the toner image T, so that toner is prevented from scattering.

As we have discussed, according to the first image formation system of the invention, the force giving means causes a force in the attraction direction toward the intermediate transfer medium to act on the toner image transferred onto the intermediate transfer medium, thus suppressing lowering the toner holding force of the intermediate transfer medium at a place where charge on the intermediate transfer medium diminishes just after the toner image is transferred. Resultantly, repellant of charges of toner is prevented from causing the toner to scatter and high-quality images can be provided.

According to the second image formation system of the invention, the force giving means disposed between a transfer position and a fixing position causes a force in the attraction direction toward a recording medium to act on the toner image transferred onto the recording medium, thus suppressing lowering the toner holding force of the recording medium at a place where charge on the recording medium diminishes just after the toner image is transferred. Resultantly, repellant of charges of toner is prevented from causing the toner to scatter and high-quality images can be provided.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image formation system, comprising:

an electrostatic latent image support for supporting an electrostatic latent image;

means for forming an electrostatic latent image on said electrostatic latent image support;

means for developing the electrostatic latent image formed on said electrostatic latent image support in toner, thereby forming a toner image on said electrostatic latent image support;

an intermediate transfer medium;

first transfer means for transferring the toner image formed on said electrostatic latent image support to said intermediate transfer medium at a first transfer location;

force giving means for causing a force in a direction toward said intermediate transfer medium to act on the toner image transferred onto said intermediate transfer medium, said force acting on the toner image outside of the first transfer location;

a recording medium; and second transfer means for transferring the toner image transferred onto said intermediate transfer medium onto said recording medium.

2. The image formation system as claimed in claim 1 wherein said force giving means is electric field giving means for causing an electric field to act on the toner image for giving the force in the direction toward said intermediate transfer medium to the toner image.

3. The image formation system as claimed in claim 2 wherein said electric field giving means includes a charger which is placed on an opposite side to said electrostatic latent image support with respect to said intermediate transfer medium.

4. The image formation system as claimed in claim 3, further comprising a grounded counter electrode being placed on an opposite side to said charger with respect to said intermediate transfer medium and at a position facing said charger.

5. The image formation system as claimed in claim 3, further comprising a counter electrode having a potential of an opposite polarity to a charge polarity of said charger, said counter electrode being placed on an opposite side to said charger with respect to said intermediate transfer medium and at a position facing said charger.

6. The image formation system as claimed in claim 2, wherein said electric field giving means comprises a first electrode being placed on an opposite side to said electrostatic latent image support with respect to said intermediate transfer medium, a first voltage being applied to said first electrode; and a second electrode being placed on an opposite side to said first electrode with respect to said intermediate transfer medium and at a position facing said first electrode, a second voltage different in value from the first voltage being applied to said second electrode.

7. The image formation system as claimed in claim 6, wherein the toner for making the toner image is negative-polarity toner, and wherein the second voltage applied to said second electrode is lower than the first voltage applied to said first electrode.

8. The image formation system as claimed in claim 6, wherein the toner for making the toner image is positive-polarity toner, and wherein the second voltage applied to said second electrode is higher than the first voltage applied to said first electrode.

9. The image formation system as claimed in claim 1 wherein said first transfer means also serves as said force giving means for giving the force in the direction toward said intermediate transfer medium to the toner image transferred to said intermediate transfer medium.

10. The image formation system as claimed in claim 1 wherein the toner for making the toner image is magnetic substance, and wherein said force giving means is magnetic field giving means for causing a magnetic field to act on the toner image for giving the force in the direction toward said intermediate transfer medium to the toner image.

11. The image formation system as claimed in claim 1, wherein said intermediate transfer medium is made of a material to allow air to pass therethrough, and wherein said force giving means is air suction means for causing the force in the direction toward said intermediate transfer medium to act on the toner image on said intermediate transfer medium from a rear side of the surface of said intermediate transfer medium onto which the toner image is transferred.

12. An image formation system comprising:

an electrostatic latent image support on which an electrostatic latent image is formed;

means for forming an electrostatic latent image on said electrostatic latent image support;

means for developing the electrostatic latent image formed on said electrostatic latent image support in toner, thereby forming a toner image on said electrostatic latent image support;

a recording medium;

means for transferring the toner image formed on said electrostatic latent image support to said recording medium at a predetermined transfer position;

fuser means for fixing the toner image transferred to said recording medium on said recording medium at a predetermined fixing position;

means for transporting said recording medium along a predetermined transport passage through the predetermined transfer position and the predetermined fixing position; and force giving means for causing a force in a direction toward said recording medium to act on the toner image transferred onto said recording medium between the predetermined transfer position and the predetermined fixing position on the predetermined transport passage, wherein said means for transferring the toner image also serves as said force giving means and at least a portion of the force giving means is located between the predetermined transfer position and the predetermined fixing position.

13. The image formation system as claimed in claim 12 wherein said transfer means transfers the toner image formed on said electrostatic latent image support directly to said recording medium.

14. The image formation system as claimed in claim 12 further including an intermediate transfer medium, wherein said transfer means once transfers the toner image formed on said electrostatic latent image support to said intermediate transfer medium and then transfers to said recording medium.

15. The image formation system as claimed in claim 12 wherein said force giving means is electric field giving means for causing an electric field to act on the toner image for giving the force in the direction toward said recording medium to the toner image.

16. The image formation system as claimed in claim 15 wherein said electric field giving means includes a charger which is placed on an opposite side to said electrostatic latent image support with respect to said recording medium between the predetermined transfer position and the predetermined fixing position on the predetermined transport passage.

17. The image formation system as claimed in claim 16, further comprising a grounded counter electrode being placed on an opposite side to said charger with respect to said recording medium between the predetermined transfer position and the predetermined fixing position on the predetermined transport passage and at a position facing said charger.

18. The image formation system as claimed in claim 16, further comprising a counter electrode having a potential of an opposite polarity to a charge polarity of said charger, said counter electrode being placed on an opposite side to said charger with respect to said recording medium between the predetermined transfer position and the predetermined fixing position on the predetermined transport passage and at a position facing said charger.

19. An image formation system comprising:

an electrostatic latent image support on which an electrostatic latent image is formed;

means for forming an electrostatic latent image on said electrostatic latent image support;

means for developing the electrostatic latent image formed on said electrostatic latent image support in toner, thereby forming a toner image on said electrostatic latent image support;

a recording medium;

means for transferring the toner image formed on said electrostatic latent image support to said recording medium at a predetermined transfer position;

fuser means for fixing the toner image transferred to said recording medium on said recording medium at a predetermined fixing position;

means for transporting said recording medium along a predetermined transport passage through the predetermined transfer position and the predetermined fixing position; and force giving means for causing a force in a direction toward said recording medium to act on the toner image transferred onto said recording medium between the predetermined transfer position and the predetermined fixing position on the predetermined transport passage, said force giving means being electric field giving means for causing an electric field to act on the toner image for giving the force in the direction toward said recording medium to the toner image, wherein said electric field giving means comprises: a first electrode being placed on an opposite side to said electrostatic latent image support with respect to said recording medium between the predetermined transfer position and the predetermined fixing position on the predetermined transport passage, a first voltage being applied to said first electrode; and a second electrode being placed on an opposite side to said first electrode with respect to said recording medium and at a position facing said first electrode, a second voltage different in value from the first voltage being applied to said second electrode.

20. The image formation system as claimed in claim 19 wherein the toner for making the toner image is negative-polarity toner, and wherein the second voltage applied to said second electrode is lower than the first voltage applied to said first electrode.

21. The image formation system as claimed in claim 19 wherein the toner for making the toner image is positive-polarity toner, and wherein the second voltage applied to said second electrode is higher than the first voltage applied to said first electrode.

22. The image formation system as claimed in claim 12 wherein the toner for making the toner image is magnetic substance, and wherein said force giving means is magnetic field giving means for causing a magnetic field to act on the toner image for giving the force in the direction toward said recording medium to the toner image.

* * * * *